United States Patent [19]

Judd et al.

[11] 4,025,888

[45] May 24, 1977

[54] FUSE AND VISUAL INDICATOR MOUNTING APPARATUS

[75] Inventors: James Hewitt Judd, St. Charles; Joseph Charles Manganello, Naperville, both of Ill.

[73] Assignee: Bell Telephone Laboratories, Incorporated, Murray Hill, N.J.

[22] Filed: Dec. 29, 1975

[21] Appl. No.: 645,247

[52] U.S. Cl. ..... 337/266; 337/271

[51] Int. Cl.[2] ..... H01H 85/32

[58] Field of Search ..... 337/265, 266, 268, 271; 317/116

[56] References Cited

UNITED STATES PATENTS

| | | | |
|---|---|---|---|
| 2,422,886 | 6/1947 | Chittum | 337/266 |
| 3,047,695 | 7/1962 | Borys | 337/266 X |
| 3,161,748 | 12/1964 | Linton | 337/266 X |
| 3,229,065 | 1/1966 | Borys | 337/266 X |

*Primary Examiner*—George Harris
*Attorney, Agent, or Firm*—John C. Albrecht

[57] ABSTRACT

A mounting block comprises a plurality of identically structured mounting cups in which are positioned alternatively a fuse support or a light emitting diode (LED) support. Each LED is associated with a fuse to provide a visual status display of the fuse. As disclosed, the fuse elements and the LED elements are positioned in alternate of the mounting cups.

6 Claims, 2 Drawing Figures

FUSE AND VISUAL INDICATOR MOUNTING APPARATUS

BACKGROUND OF THE INVENTION

This invention relates to mounting structures for fuses and fuse status indicators and more particularly to a fuse mounting block and associated fuse and visual indicator elements arranged for alternate positioning in the mounting block.

In certain applications it is desirable to use a light emitting diode (LED) to provide a visual indication of whether or not an associated fuse has blown, for example, where there are a large number of fuses and it is desired to rapidly locate a blown fuse.

LEDs have been used for indicating fuse status in the prior art; however, a mounting problem has existed. One prior solution to the mounting problem has been to provide a second independent panel for mounting the LEDs, but this approach has a number of drawbacks; for example, it requires the introduction of a different mounting apparatus which causes problems due to physical mounting of the new panel as well as mounting the LEDs in the panel and making wiring connections to them. As a result of these problems, there exists a need for a unified mounting apparatus for fuses and LEDs that is compatible with standard mounting and wiring techniques.

SUMMARY OF THE INVENTION

In accordance with this invention, a unified fuse and LED indicator mounting apparatus is provided which comprises a block having a number of cup shaped mounting elements. In accordance with an aspect of my invention, all of these mounting elements are substantially identically structured.

Each of the mounting elements in the block is formed of a cup having a contact at its base and a contact ring adjacent to but removed from the face of the block, a key slot or channel extending from the face into the cup and then at right angles towards the contact ring. Appropriate electrical connections are made to the base contact and contact ring for connection of the electrical element positioned in the mounting element to the external circuitry being protected.

Two types of electrical elements are positioned in these mounting cups and advantageously they may be mounted in alternate ones of the cups. Both types of electrical elements, however, have substantially the same physical outer shape. The first of these elements comprises a fuse and a fuse support or cover. The second of these elements comprises a hollow sleeve at the upper end of which is mounted an LED. Both of these structures have a contact or terminal cap which bears against the base contact of the mounting element and a contact including an outer extending conductive lug which fits into the key channel and makes electrical contact with the contact ring in the mounting cup. Further both of these structures includes a retaining ring formed integrally therewith to bear against the upper surface of the mounting block to limit the insertion of the electrical element into the mounting cup and to serve, with the contact lug in the key slot, to retain the electrical element firmly in the mounting cup.

Since the visual indicators, in accordance with my invention, are mounted by the same mounting block as the fuses themselves, a standard unified mounting arrangement is provided, obviating the need for any separate mounting panels for the visual indicators and thereby also resolving the prior wiring problems.

DESCRIPTION OF THE DRAWING

This invention will be more fully understood from the following detailed description taken in conjunction with the accompanying drawing, in which.

DETAILED DESCRIPTION

Figure 1:
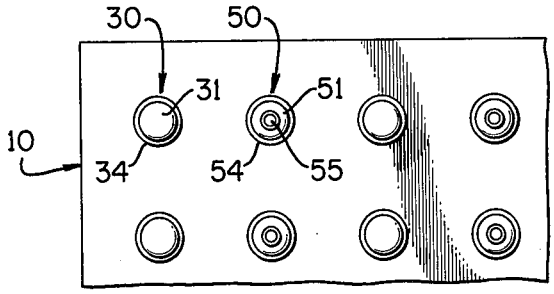
FIG. 1 is a front view of a portion of a fuse and indicator equipment in accordance with my invention.

Turning now to the drawing, the specific embodiment of my invention depicted therein comprises a mounting block 10 in which are mounted alternate fuses and visual indicators, each visual indicator being associated with the adjacent fuse to its left in the drawing. As seen in FIG. 1, the craftsperson who looks at the mounting block sees only the cover or fuse mounting body 31 together with an integral stop ring 34, as described further below, and the end of the visual indicator mounting sleeve 51, the integral stop ring 54, and the front of the light emitting diode 55. When a fuse has blown, the associated light emitting diode 55 mounted directly to its right will be energized, thereby making prompt identification and replacement of the blown fuse very simple.

Figure 2:
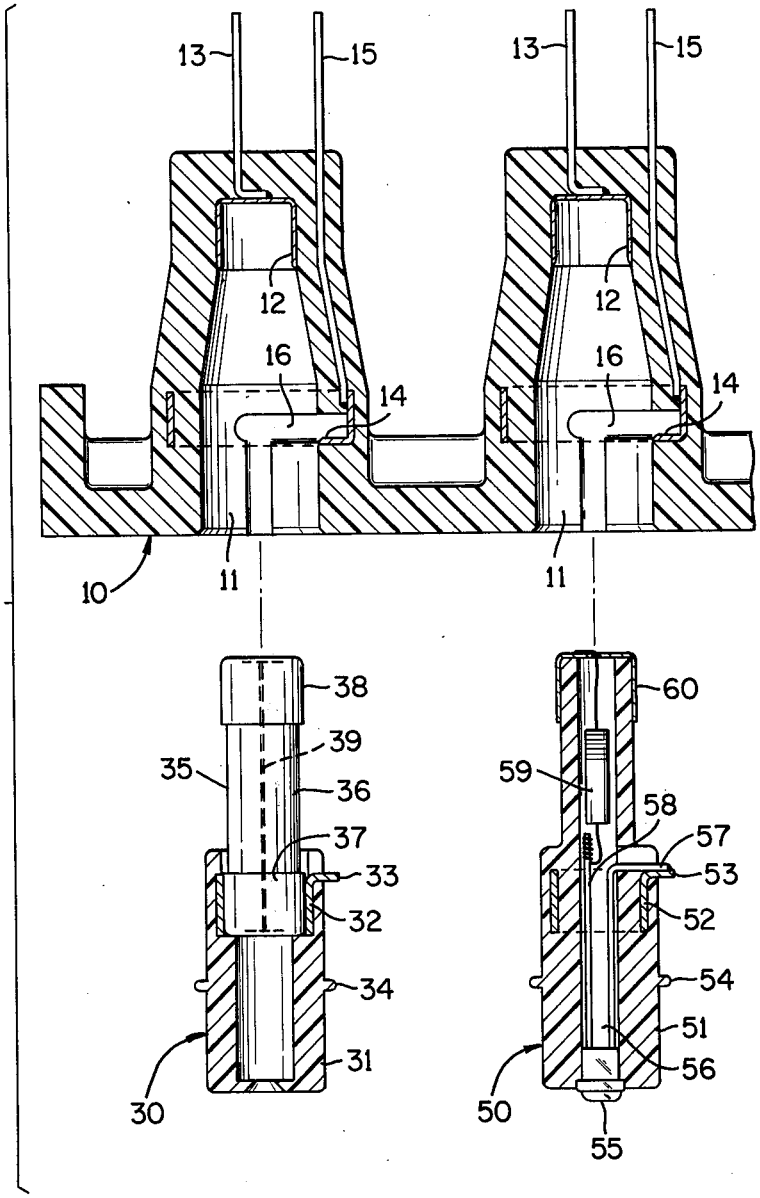
FIG. 2 is a sectional view of the mounting block of the equipment of FIG. 1 and of an associated fuse and visual indicator, the fuse and visual indicator being depicted removed from the mounting block for clarity.

As clearly seen in FIG. 2, the mounting block 10 comprises a plurality of cup shaped mounting elements 11 into which the fuse and visual indicator bodies are inserted, the cup shaped mounting element 11 being integrally formed in the block 10 which is advantageously of a nonconductive plastic, as is known in the art.

Each of the mounting elements 11 is generally cup shaped and includes an electrical contact 12 at its base for establishing electrical contact to the inner contact of the electrical element to be inserted therein and a first electrical conductor 13 for connecting the contact 12 to an external electrical circuit. A second electrical contact 14 is positioned within the cup adjacent the face of the mounting block 11 but removed from the face and may advantageously be a ring molded into the block 10; a second electrical conductor 15 extends along the side of the cup within the block 10 to provide connection for the second contact 14 to the external electrical circuit. Lastly, a channel or slot 16 extends from the face of the mounting block 10 down to the vicinity of the second contact 14 and then at right angles thereto and extends to the contact 14.

The electrical elements for insertion into the mounting block comprise a fuse and an associated light emitting diode and the electrical elements are similarly shaped insofar as their outer configurations are concerned. The first group of electrical elements 30 comprise the fuses and the second group of electrical elements 50 the light emitting diodes. Each of the first group of elements 30, as clearly seen in FIG. 2, includes a fuse mounting body or cover 31 and an electrical contact 32 adapted to receive and securely hold one end of a fuse and establish an electrical contact therewith and including an electrically conductive lug or key 33 adapted to be inserted in channel 16 in such a way that electrical contact is established with contact 14 and the mounting is firmly held in the mounting element 11. The key 33 cooperates with the channel 16 and a stop 34 which comprises a raised ring portion of body 31 arranged such that the body 31 can only be inserted into aperture 11 a limited distance.

A fuse 35 for use in cooperation with fuse mounting 30 and aperture 11 of fuse block 10 may comprise a fuse body 36, electrically conductive end caps 37 and 38, and a fuse wire 39 residing within fuse body 36 and electrically connected to end caps 37 and 38, as is known in the art. The fuse 35 is positioned with its end cap fitting into the conductive contact ring 32 of the fusing mounting body or cover 31 so as to be held thereby.

Each of the second group of elements 50 is, in accordance with an aspect of my invention, similarly shaped with the first group of elements 30 and may thus be similarly inserted into mounting elements 11 in the fuse and indicator block 10. As seen in FIG. 2, each of the elements 50 defines a visual indicator and comprises a hollow sleeve 51, a first electrical contact 52 including an electrically conductive key 53 adapted to be inserted in channel 16 such that electrical contact is established with terminal 14 and the visual indicator is firmly held in the mounting element 11. The key 53 cooperates with channel 16 and a stop 54 such that sleeve 51 can only be inserted into mounting element 11 a limited distance. A light emitting diode 55 is inserted in the end of the central aperture 56 in the sleeve 51 such that an electrical terminal 57 of light emitting diode 55 is electrically connected to terminal 52 and key 53 and a second electrically conductive terminal 58 of light emitting diode 55 is connected to a first terminal of a resistor 59. A second terminal of resistor 59 is connected to a second electrically conductive terminal cap 60 which is adapted to establish an electrical contact with terminal 12 of the base of mounting element 11.

It may be desirable in certain applications to provide some means of insuring that fuse mountings and visual indicators are inserted in the correct apertures, for example, by constructing a different keying arrangement for fuse mountings and for visual indicators such that they may not be interchanged or by color coding the appropriate apertures and mounting devices.

In this specific embodiment of my invention, as described above with reference to FIG. 1, the fuse and visual indicator bodies are alternately positioned in the mounting elements 11 of the mounting block 10 and each fuse 35 is associated with the light emitting diode 55 to its right. In operation then, the leads 13, 15 are connected to the external electrical circuits. Thus, if a fuse element 39 of a fuse 35 blows because of excessive current in the associated external circuit, the conductive path for current through the fuse element 39 is broken and the current flows through the associated light emitting diode 55 parallelly connected thereto, whereby a visual indication is given specifically identifying the now defective fuse.

Resistor 59 may optionally be connected to the external leads 13, 15 of a mounting element 11 in which the visual indicator 50 is to be positioned. In this case, the lead 58, or an extension thereof, extends directly to the connector cap 60.

What is claimed is:

1. Fuse and indicator equipment comprising a mounting block having a plurality of identical mounting elements integrally formed therewith, each of said mounting elements having a first electrical contact at its base and an opening at the face of the block, a second electrical contact adjacent but removed from said face and means defining a key slot extending down from said face and then at right angles thereto to said second electrical contact;

a plurality of identically shaped electrical elements mounted in said mounting elements;

a first group of said electrical elements each comprising a fuse extending between said first and second contacts and having one end in contact with said first contact, a conductive lug connecting the other end of said fuse to said second contact in said key slot and a cover extending above the face of said mounting block; and a second group of said electrical elements comprising a hollow nonconducting sleeve having a conductive cap at one end thereof engaging said first contact, a conductive lug in said key slot and engaging said second contact, a light emitting diode mounted in said hollow nonconducting sleeve above the face of said mounting block and connected to said conductive cap and to said conductive lug.

2. Fuse and indicator equipment comprising a mounting block having a plurality of substantially identical mounting elements integrally formed therewith, each of said mounting elements having a first electrical contact at its base and an opening at the face of the block, a second electrical contact adjacent but removed from said face and means defining a key slot extending down from said face and then at right angles thereto to said second electrical contact; and a plurality of substantially identically shaped electrical elements mounted in said mounting elements;

at least another of said electrical elements comprising a hollow conductive sleeve;

a first group of said electrical elements each comprising a fuse extending between said first and second contacts and having one end in contact with said first contact, a conductive lug connecting the other end of said fuse to said second contact in said key slot and a cover extending above the face of said mounting block; and a second group of said electrical elements comprising a hollow nonconducting sleeve having a conductive cap at one end thereof engaging said first contact, a conductive lug in said key slot and engaging said second contact, a light emitting diode mounted in said hollow nonconducting sleeve above the face of said mounting block and connected to said conductive cap and to said conductive lug.

3. Fuse and indicator equipment comprising a mounting block having a plurality of identical mounting elements integrally formed therewith, each of said mounting elements comprising a cup having a first electrical contact at its base and an opening at the face of the block, a second electrical contact in said cup adjacent but removed from said face and means defining a key slot extending down from said face and then at right angles thereto in said cup to said second electrical contact;

a plurality of identically shaped electrical elements mounted in said mounting elements;

first alternate ones of said electrical elements each comprising a fuse extending between said first and second contacts and having one end in contact with said first contact, a conductive lug connecting the other end of said fuse to said second contact in said key slot and a cover extending above the face of said mounting block; and second alternate ones of said electrical elements comprising a hollow nonconducting sleeve having a conductive cap at one end thereof engaging said first contact, a conductive lug in said key slot and engaging said second contact, a light emitting diode mounted in said hollow nonconducting sleeve above the face of said mounting block and connected to said conductive cap and to said conductive lug.

4. Fuse and indicator equipment in accordance with claim 3 further comprising first and second wires respectively contacting each of said first and second contacts and means connecting alternate of said first wires together and alternate of said second wires together.

5. Fuse and indicator equipment in accordance with claim 4 further comprising a resistor connecting said light emitting diode to said conductive cap.

6. Fuse and indicator equipment in accordance with claim 3 wherein said first element covers and said second element sleeves each have a retaining ring formed integrally therewith for limiting the insertion of said first and second electrical elements into said mounting elements.

* * * * *